US006634127B2

(12) United States Patent
Bauer

(10) Patent No.: US 6,634,127 B2
(45) Date of Patent: Oct. 21, 2003

(54) PICTURE FRAME

(76) Inventor: Gerhard Bauer, Oed 48, A-8311 M. Hartmannsdorf (AT)

( * ) Notice: Subject to any disclaimer, the term of this patent is extended or adjusted under 35 U.S.C. 154(b) by 11 days.

(21) Appl. No.: 09/954,162

(22) Filed: Sep. 18, 2001

(65) Prior Publication Data

US 2002/0046477 A1 Apr. 25, 2002

(30) Foreign Application Priority Data

Sep. 18, 2000 (AT) ..... 684/2000 U

(51) Int. Cl.[7] ..... A47G 1/06
(52) U.S. Cl. ..... 40/792; 40/759; 40/762
(58) Field of Search ..... 40/746, 754, 759, 40/761, 762, 777, 790, 792, 796, FOR 156

(56) References Cited

U.S. PATENT DOCUMENTS 2,368,054 A * 1/1945 Viglietta ..... 40/746 X
3,686,783 A * 8/1972 Levy ..... 40/746
4,805,325 A * 2/1989 Cassard ..... 40/746 X
4,974,351 A * 12/1990 Ghislanzoni ..... 40/792
5,335,434 A * 8/1994 Shultz et al. ..... 40/759 X
5,815,971 A * 10/1998 Rothe et al. ..... 40/792 X

FOREIGN PATENT DOCUMENTS

EP 0 433 246 A1 6/1991

* cited by examiner

*Primary Examiner*—Joanne Silbermann
(74) *Attorney, Agent, or Firm*—Young & Thompson

(57) ABSTRACT

A picture frame with a frame (1, 2) has clamps (6, 7, 8, 9) for securing parts (3, 4, 5) inserted into the frame, such as a pane of glass, a picture, a rear wall, etc. The clamps (6, 7, 8, 9) have a bridge (14) and a spring clip (15). On the inside (12) of the frame (1, 2) a projection (17) is inserted into a recess (13). On the end of the bridge (14) there is another projection (16) which is inserted into a recess (11) on the back (10) of the frame (1, 2). On the end of the spring clip (15) there is a third projection (18) which is inserted into a recess (23) on the back (21) of the rear wall (5). This enables very adaptable and reliable mounting of the parts (3, 4, 5) in the frame (1).

18 Claims, 2 Drawing Sheets

PICTURE FRAME

BACKGROUND OF THE INVENTION

The invention relates to a picture frame with a frame and clamps for securing the parts inserted into the frame, such as a pane of glass, a picture, a rear wall, etc.

Securing the parts which have been inserted into a picture frame by mean of clamps, photocorners, elastic clips or the like is known. These known attachment mechanisms however have the disadvantage that they, like, for example, photocorners which must be driven into the frame, are difficult to handle, easily slip, like, for example, spring clips, or do not exert a sufficient clamping action on the inserted parts, or can only be poorly adapted, when for example the total thickness of the inserted parts is changed, for example by inserting or removing a mount.

Therefore the object of the invention is to make available a picture frame with clamps which on the one hand exerts a very good holding action on the inserted parts and on the other hand has high flexibility with respect to the total thickness of the inserted parts.

SUMMARY OF THE INVENTION

In the invention, on the inside of the frame side there are recesses into which the clamps can be inserted with their projection. The spring clip then elastically adjoins the back of the rear inserted parts, for example the rear wall, by which at the same time the bridge which lies on the side which is opposite with respect to the projection is pressed against the frame. Since the intensity of the spring force of the spring clip or the spring path can be easily influenced by the corresponding configuration of the spring clip or the clamp, the attachment possibility for the parts in the picture frame is extremely adaptable.

To prevent slippage of the clamp transversely to the frame side and thus to prevent the clamps from coming loose from the picture frame, in one preferred embodiment of the invention it can be provided that the clamps on the end of the bridge have another projection which can be inserted into the recess on the back of the frame. Shifting or slipping of the clamp transversely to the side can be made largely impossible by the additional projection which fits into a recess.

To achieve this, it can be provided alternatively or additionally that on the end of the spring clip there is a projection which can be inserted into a recess on the back of the rear wall. The latter embodiment has the additional advantage that the frame sides are connected via the clamps transversely to the lengthwise extension of the sides by form-fit to the rear wall. This is especially advantageous if the frame sides are very long and thin and thus could be easily bent to the outside; this is prevented by the aforementioned embodiment of the invention.

To facilitate insertion or removal of the clamps, in a development of the invention it can be provided that the spring clip has an extension as a handle.

Furthermore, in a development of the invention it can be provided that there is an opening in the spring clip and/or in the bridge and/or in the extension of the spring clip. The opening, or if there are several openings, one of the openings, can be used for example to hang the picture frame on a nail. When there is an opening in the spring clip or in its extension, a tool, for example, a screwdriver, can be inserted into the opening in order to bend up the spring clip to remove the clamp so that the projection is pushed out of the recess on the inside of the frame side and the clamp can thus be removed.

The recesses on the frame and on the rear wall can be produced in different ways. Thus it is possible to mill grooves into the back of the frame and optionally the rear wall, the grooves running over the entire length, or they can also have a shorter length. It is also possible to make the recesses as holes or punchouts.

Since relatively high clamping forces are possible by the attachment of the clamps to the frame as claimed in the invention even at different total thicknesses of the inserted parts, in one preferred embodiment of the invention it can be provided that there is a stand which can be clamped between a spring clip and the rear inserted part.

Other advantageous embodiments of the invention are the subject matter of the other dependent claims.

BRIEF DESCRIPTION OF THE DRAWINGS

Preferred embodiments of the invention are detailed below with reference to the drawings.

DESCRIPTION OF THE PREFERRED EMBODIMENTS

Figure 1:
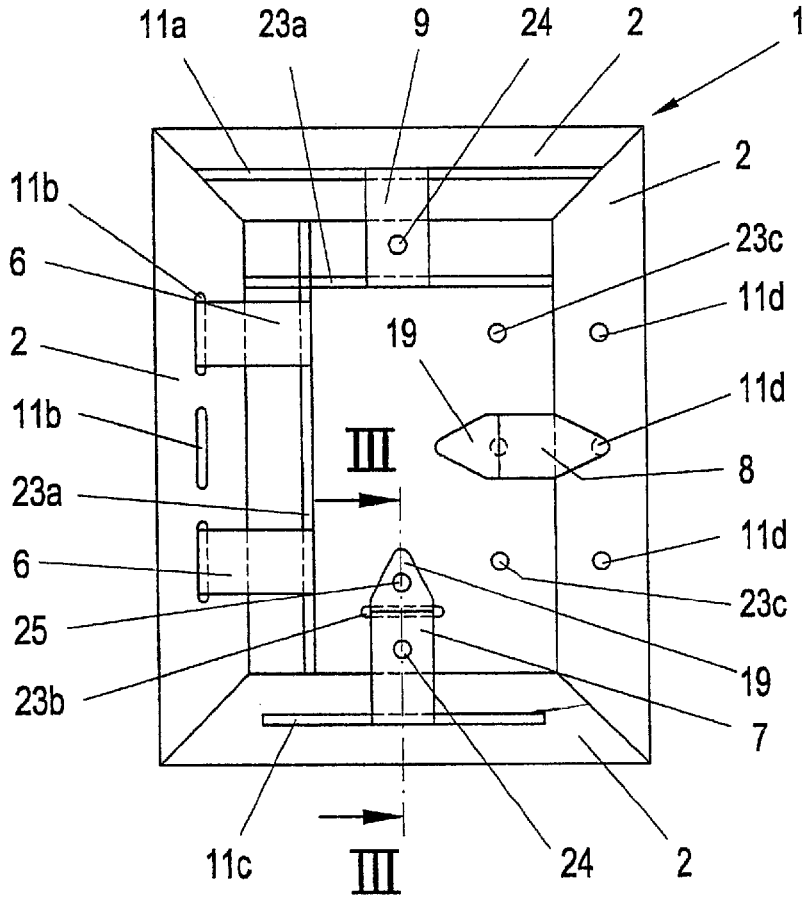
FIG. 1 shows the back of the frame with different embodiments of the invention.
Figure 3:
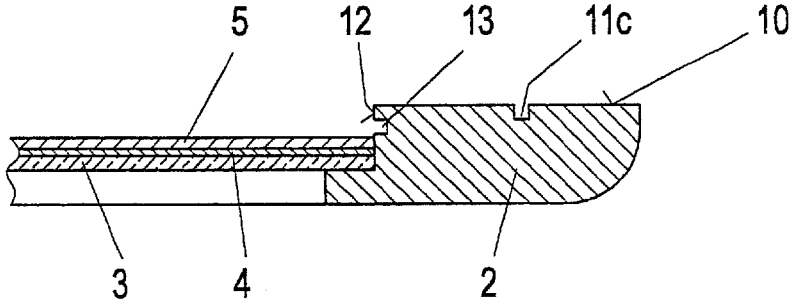
FIG. 3 shows a section through the picture frame from FIG. 1 along line III—III.

FIG. 1 shows the back of the picture frame as claimed in the invention, which has a frame 1 with four frame sides 2. For example, a pane 3 of glass, a picture 4 and a rear wall 5 are inserted into the frame 1, as FIG. 3 shows. These inserted parts 3, 4 and 5 are secured by means of clamps 6, 7, 8 and 9 which are shown in FIG. 1 in four embodiments.

On the frame sides 2 on their back 10 there are recesses 11 and on the insides 12 of the frame sides 2 there are recesses 13 (FIG. 3). The recesses 11 can be either grooves 11*a*, 11*b* and 11*c* or holes 11*d*. FIG. 1 shows three possible embodiments of grooves, that is, a groove 11*a*, which runs over the entire length of the top frame side 2, a number of shorter grooves 11*b*, such as is shown on the left frame side 2, or a longer groove 11*c* which does not run over the entire length of the frame side 2, as is shown on the lower frame side 2 in FIG. 1. Alternatively there can also be holes, as is shown on the right frame side 2 in FIG. 1. Compared to the grooves, the holes have the advantage that pegs which have been inserted in them cannot slip laterally, as in grooves; this could result in the detachment of the clamps.

Figure 2:
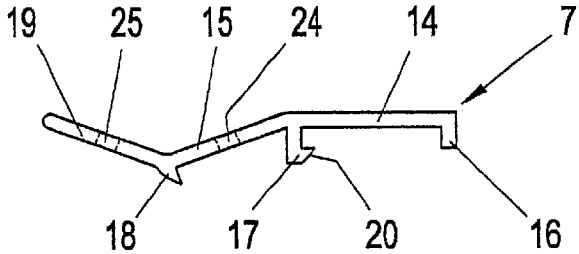
FIG. 2 shows one embodiment of a clamp as claimed in the invention.

FIG. 2 shows as one preferred embodiment of a clamp as claimed in the invention the clamp 7 from FIG. 1 in a side view. The clamp 7 has a bridge 14, a spring clip 15 and projections 16, 17, and 18. In this respect all clamps 6, 7, 8, 9 from FIG. 1 are made the same. In the clamps 7 and 8 the spring clip 15 adjoining the projection 18 has another extension 19 which on the one hand can be used as a handle for more easily removing the clamps and on the other hand to facilitate pushing on a stand 26 which will be described later.

The recesses 13 on the inside 12 of the frame sides 2 are preferably made as grooves 13 which run over the entire length of the side, but can likewise be grooves of limited length or punchouts or holes. The projection 17 has an angled end 20 with a face surface which is made bevelled. This facilitates insertion of the clamps, especially when this is to be done mechanically, since the projection 17 then slides more easily over the inside edge of the frame side 2.

Figure 4:
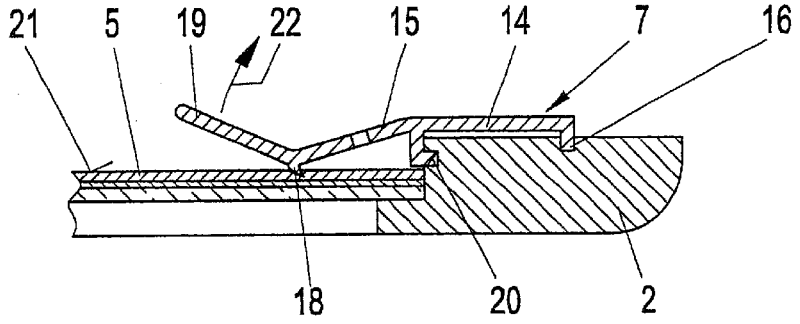
FIG. 4 shows a section corresponding to FIG. 3 with the clamp inserted.

As FIG. 4 shows, the clamp 7 in the inserted state with the projection 16 on the free end of the bridge 14 fits into the groove 11*c* on the frame side 2, the angled free end 20 of the projection 17 fits into the groove 13 on the inside of the frame side 2 and the projection 18 lies on the back 21 of the rear wall 5. The spring clamp 15 is thus pretensioned, at the same time resulting in the projection 16 being pressed securely into the groove 11*c*. If the clamp 7 is to be removed, the extension 19 in the direction of the arrow 22 is bent up so far that the angled end 20 of the projection 17 slides out of the groove 13 with simultaneous bending of the bridge 14, by which the clamp 7 can be easily removed.

When there are likewise recesses on the rear wall 5, either in the form of grooves 23*a*, 23*b* or holes or punchouts 23*c* (see FIG. 1), the projection 18 on the spring clip 15 can fit into this recess 23; this contributes to further position stabilization of the clamps and subsequently also of the frame sides 2. Especially for long and thin frame sides 2 they are prevented from being unintentionally bent to the outside since they are secured via the clamps in the recesses 23.

So that the projection 18 is hooked more securely into the groove 23*a* on the back wall 5, it is made wedge-shaped and has a surface 39 which is turned towards the bridge 14 and which is tilted at an angle greater than 90° with respect to the back 21 away from the bridge 14.

In this way the projection 18 hooks in the appropriately shaped groove 23*a* if the frame side 2 should be bent to the outside, i.e. away from the rear wall 5.

Depending on whether the recesses 11 and 13 on the frame 1 or on the frame sides 2 and on the back 21 of the rear wall 5 are grooves or holes, the projections 16, 17 and 18 on the clamps are made elongated or round so that they fit exactly into the respective recess.

To facilitate hanging of the picture frame on the wall, in the embodiments shown in the form of clamps 7 and 9 in the bridge 14 there is an opening 24 using which the picture frame can be hung on a nail or hook which has been driven into the wall. The opening 24 can be used at the same time also for insertion of a tool, for example a nail or a screwdriver, to facilitate removal of the clamp 7 or 9; this is especially advantageous when the clamp does not have an extension 19 of the spring clip 15, as is shown in the form of the clamp 9. There can also be an opening 25 in the extension 19, which opening can be used for the same purpose as the opening 24.

Figure 6:
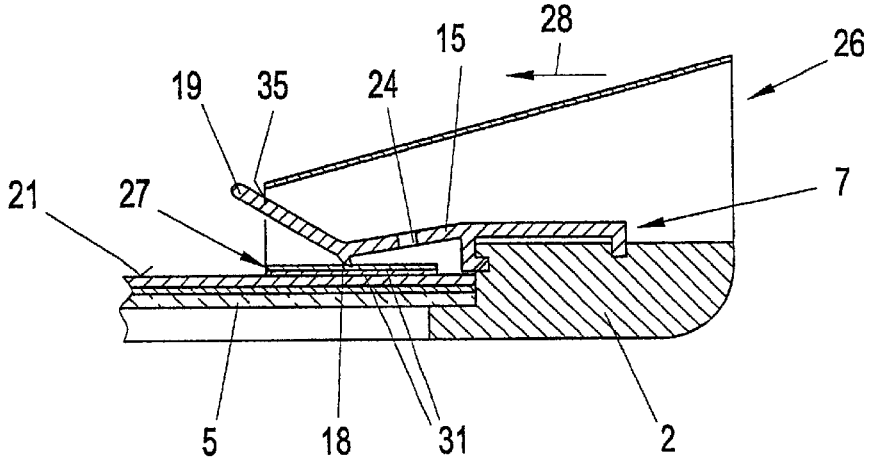
FIG. 6 shows a section through the picture frame from FIG. 1 along the line III—III, with the stand inserted.

Since relatively high forces can be applied by the execution of the frame sides 2 and the clamps 6 to 9 as claimed in the invention, even if the total thickness of the inserted parts 3, 4 and 5 changes, this clamping action can be used to secure a stand 26 between the clamp 7 and the rear wall 5, as is shown in FIG. 6. The stand 26 is secured with a section 27 between the spring clip 15 and the projection 18 located thereon and the back 21 of the rear wall 5. To prevent movement or slipping of the stand 26 transversely to the lengthwise extension of the frame side 2 (arrow 28), on the section 27 there can be grooves into which the projection 18 fits and thus secures the stand 26 by form-fit on the frame side 2.

Figure 5:
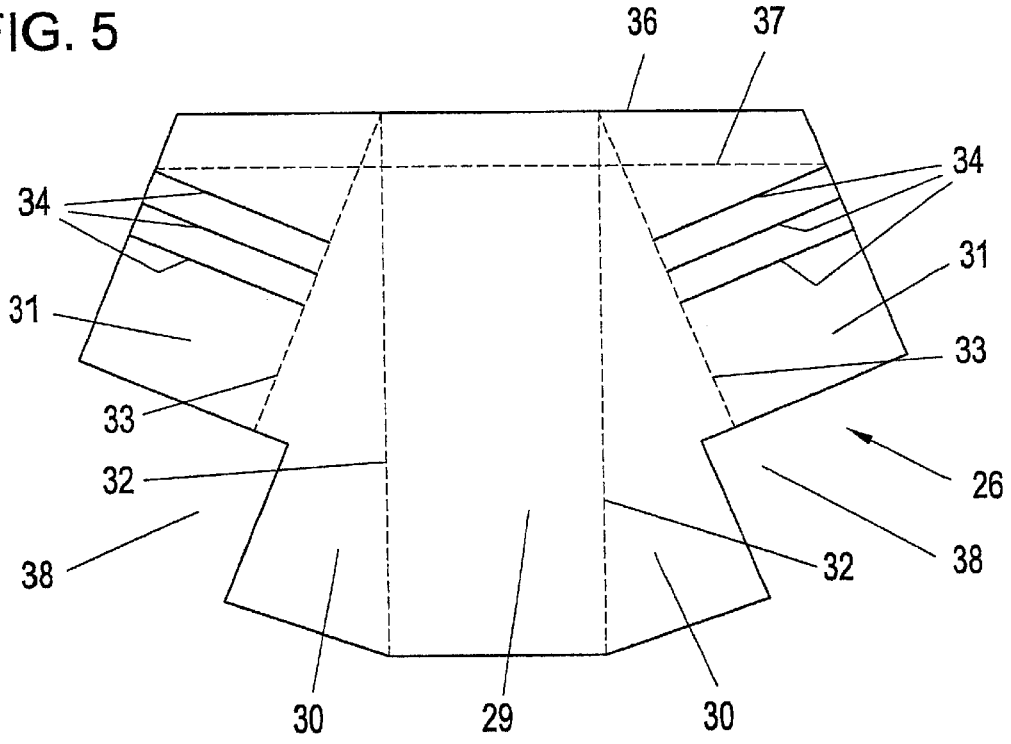
FIG. 5 shows a pattern for an embodiment of a stand as claimed in the invention.

Preferably the stand 26 is made from a pattern as is shown in FIG. 5. This section can be easily added to the picture frame since it is flat, and at the same time for example operating instructions can be imprinted. The pattern of the stand 26 is preferably made of solid cardboard, but can also consist of plastic or sheet metal.

The stand 26 consists of a rectangular middle part 29, two essentially triangular side walls 30 and two trapezoidal wings 31. To facilitate the folding of the stand 21 together, bending lines 32 and 33 can be impressed beforehand; they delineate the middle part 29, the side parts 30 and the wings 31 from one another. On one or both wings 31 there can be the aforementioned grooves 34, for example, impressed, and the number of grooves 34 can be varied depending on the size or the weight of the picture frame.

If the stand 26 is folded along the bending lines 32 and 33 such that the two wings 31 come to rest on one another, then the two wings 31 can be pushed lying on top of one another between the clamp 7 and the rear wall 5, as FIG. 6 shows. This pushing-in of the section 27 of the stand 26, i.e. the section formed by the wings 31, is facilitated by the projecting extension 19 of the spring clip 15. Alternatively or in addition, the spring clip 15 can also be lifted up with a tool, for example, a screwdriver, which if present, can be inserted into the opening 24 or 25.

The embodiment of a pattern for the stand 26 shown in FIG. 5 differs from the embodiment shown in FIG. 6 in that the stand 26 from FIG. 6 in the area of its tip has an opening 35 through which the extension 19 can project or at least can be made accessible. In the embodiment of the pattern shown in FIG. 5, this opening 35 would not be present. But it can be produced for example by the edge 36 lying not, as shown in FIG. 5, at the site shown by the solid line, but instead at the site which is shown by the broken line 37, by which the opening 35 is formed automatically upon folding together.

So that the stand 26 can be easily attached to the picture frame, on the pattern there are free spaces 38 in which the frame side 2 in the folded-together and secured state of the stand 26 comes to rest.

In summary, one embodiment of the invention can be described as follows:

A picture frame with a frame 1, 2 has clamps 6, 7, 8, 9 for securing the parts 3, 4, 5 which are inserted into the frame, such as a pane of glass, a picture, the rear wall, etc. The clamps 6, 7, 8, 9 have a bridge 14 and a spring clamp 15. A projection 17 is inserted into a recess 13 on the inside 12 of the frame 1, 2. On the end of the bridge 14 there is another projection 16 which is inserted into the recess 11 on the back 10 of the frame 1, 2.

On the end of the spring clip 15 there is a third projection 18 which is inserted into the recess 23 on the back 21 of the rear wall 5.

This enables a very adaptable and reliable attachment of the parts 3, 4, 5 in the frame 1.

What is claimed is:

1. Picture frame with a first frame (1, 2) and clamps (6, 7, 8, 9) for securing parts (3, 4, 5) inserted into the first frame, wherein each of the clamps (6, 7, 8, 9) comprises a bridge (14) and a spring clip (15), the bridge having a first projection (17) between the bridge and the spring clip and a second projection (16) at an end of the bridge opposite the first projection, wherein insides (12) of the first frame (1, 2) have first recesses (13) for insertion of the first projection (17) and a back (10) of the first frame has second recesses (11) for insertion of the second projection (16), wherein the spring clip (15) is supported on a rear of rearmost one of the parts inserted in the first frame.

2. Picture frame as claimed in claim 1, wherein the first projection (17) has one end (20) which is angled parallel to the back (10) of the first frame (1, 2) with an end face which is tilted at an angle of less than 90°.

3. Picture frame as claimed in claim 1, wherein on an end of the spring clip (15) there is a third projection (18) which is insertable into a third recess (23) on the rear of the rearmost one of the parts inserted in the first frame.

4. Picture frame as claimed in claim 3, wherein the third projection (18) on the end of the spring clip (15) is made wedge-shaped.

5. Picture frame as claimed in claim 3, wherein a surface of the third projection (18) facing the bridge (14) is tilted at an angle greater than 90° with respect to the rear of the rearmost one of the parts inserted in the first frame away from the bridge (14).

6. Picture frame as claimed in claim 1, wherein the spring clip (15) has an extension (19) as a handle.

7. Picture frame as claimed in claim 1, wherein there is an opening (24, 25) in one of the spring clip (15) and the bridge (14).

8. Picture frame as claimed in claim 1, wherein the first and second recesses are one of grooves, holes and punchouts.

9. Picture frame as claimed in claim 1, further comprising a stand (26) which can be clamped between the spring clip (6, 7, 8, 9) and the rear of the rearmost one of the parts inserted into the first frame.

10. Picture frame as claimed in claim 9, wherein the stand (26) has a section (27) which can be clamped between the spring clip (6, 7, 8, 9) and the rear of the rearmost one of the parts inserted into the first frame.

11. Picture frame as claimed in claim 10, wherein on the section (27, 31) there is at least one groove (34) into which the spring clip or its projection (18) fits.

12. Picture frame as claimed in claim 9, wherein the stand (26) is made of thin, foldable or bendable material.

13. Picture frame as claimed in claim 12, wherein the stand (26) is made of cardboard, plastic or sheet metal.

14. Picture frame with a first frame (1, 2) and clamps (6, 7, 8, 9) for securing parts (3, 4, 5) inserted into the first frame, wherein each of the clamps (6, 7, 8, 9) comprises a bridge (14) and a spring clip (15), the bridge having a first projection (17) between the bridge and the spring clip, wherein insides (12) of the first frame (1, 2) have first recesses (13) for insertion of the first projection (17), wherein the spring clip is supported on a rear of rearmost one of the parts inserted in the first frame, the picture frame further comprising a stand (26) having a section (27) which can be clamped between the spring clip and the rear of the rearmost one of the parts inserted into the first frame, wherein the stand (26) comprises a middle part (29), side parts (30) and two wings (31), and wherein the wings (31) overlap one another to form the section (27).

15. A picture frame comprising:

a first annular frame defining an opening for parts to be inserted therein, a peripheral inside surface of the first frame having a first recess therein and a rear surface of the first frame having a second recess therein; and a clamp for securing parts inserted into the first frame, the clamp comprising a bridge section and spring clip section that are attached to each other, a first projection between the bridge and the spring clip sections, and a second projection at an end of the bridge section opposite the spring clip section, the first projection being arranged and adapted to fit into the first recess and the second projection being arranged and adapted to fit into the second recess so that the spring clip section applies a spring force on parts inserted into the first frame.

16. The picture frame of claim 15, wherein the first and second recesses are generally perpendicular to each other.

17. The picture frame of claim 16, wherein the first projection has a first part that is generally parallel to the second projection and an end part that is generally perpendicular to the second projection, the end part of the first projection fitting into the first recess.

18. The picture frame of claim 15, wherein the clamp further comprises a release handle section that extends at an angle from the spring clip section in a direction opposite the bridge section.

* * * * *